United States Patent [19]

Davis, Jr. et al.

[11] Patent Number: 4,669,374

[45] Date of Patent: Jun. 2, 1987

[54] CAN-BALING MACHINE

[76] Inventors: Charles M. Davis, Jr., 23 The Point, Coronado, Calif. 92118; Robert M. Davis, 1018 Gem La., Ramona, Calif. 92065

[21] Appl. No.: 846,200

[22] Filed: Mar. 31, 1986

Related U.S. Application Data

[60] Division of Ser. No. 661,109, Oct. 15, 1984, Pat. No. 4,601,238, which is a continuation-in-part of Ser. No. 549,083, Nov. 7, 1983, abandoned.

[51] Int. Cl.[4] ..... B30B 9/32

[52] U.S. Cl. ..... 100/39

[58] Field of Search ..... 100/902, 98 R, 39, 156, 100/3, 35, 94, 95, 96, 137, 138, 139, 210, 232, 99, 249; 241/99, 237

[56] References Cited

U.S. PATENT DOCUMENTS

| | | | |
|---|---|---|---|
| 1,459,340 | 6/1923 | Nevill | 241/237 |
| 3,691,942 | 9/1972 | Wagley | 100/902 X |
| 4,179,018 | 12/1979 | Miller | 100/210 X |
| 4,398,456 | 8/1983 | Prater | 100/902 X |
| 4,483,246 | 11/1984 | Sullivan | 100/902 X |
| 4,541,332 | 9/1985 | Horansky | 100/902 X |

*Primary Examiner*—Billy J. Wilhite

*Attorney, Agent, or Firm*—Brown, Martin, Haller & Meador

[57] ABSTRACT

A method for crushing metal cans into rectangular blocks or bales wherein cans are fed through a pre-crusher, which flattens and rips open the cans to drain liquids therefrom and leaves protruding torn tabs and flaps that facilitate bonding of the cans into a self-sustaining bale. The flattened cans are collected in a charging bin until a predetermined weight is reached; then the cans are released into a bale-forming chamber, which is closed by a hinged door forming an initial compression member. A ram then compresses the cans longitudinally in the chamber, the ram having ribs on the compression face to form grooves in the bale for future stack-retaining straps. A sliding door opens the end of the baling chamber for ejection of the formed bale by continued extension of the ram.

7 Claims, 16 Drawing Figures

CAN-BALING MACHINE

This is a divisional application of Application Ser. No. 661,109 filed Oct. 15, 1984 and now U.S. Pat. No. 4,601,238 which issued on July 22, 1986 which is a continuation-in-part of application Ser. No. 549,083, filed Nov. 7, 1983 and now abandoned.

BACKGROUND OF THE INVENTION

The present invention relates to densification of cans and the like and pertains particularly to a bale-forming method.

The recycling of cans, such as beverage cans and the like, is beneficial from the point of view of both conservation of natural resources and an improvement in the environment. In order for such recycling to be practical, efficient, and high volume, densifying means for forming the cans into high-density packages for handling is necessary.

High-speed crushers have been developed for crushing individual cans to form high-density masses thereof. However, such crushers typically crush individual cans leaving the mass of cans to be handled as a group of loose articles.

Many efforts have been made in the past to form the cans into blocks or bales for ease of handling. Such past attempts, however, have required some form of binding or bonding to hold the mass of cans together as a block. The bonding of the cans together as a block mass by adhesives is objectionable because adhesive introduces an additional expensive compound into the mixture. Attempts to secure cans together as blocks by means of wires or straps have not been too successful and is also expensive.

It is therefore desirable that some means or system be available for forming cans into high-density blocks or bales without the necessity of bonds, binders, or straps.

SUMMARY OF THE INVENTION

In the method described herein the cans are initially fed through a precrusher, which substantially flattens the cans to remove any trapped liquids and also rips and tears the cans to allow the liquids to escape and to provide torn tabs and flaps projecting slightly from the cans. A predetermined weight of cans sufficient for one bale is collected and then released into a baling chamber, which is closed by a hinged door forming one wall of the chamber. A ram compresses the cans into a rectangular bale in the chamber, the torn tabs and flaps causing considerable interentangling of the cans that binds them into a firm, self-sustaining bale without the need for further restraint. Ribs on the ram form grooves in the bale to receive straps when multiple bales are bound into a standardized stack. When compression is complete, a sliding door is raised to open the chamber and allow ejection of the bale by the ram. A sequence controller times all the actions for continued automatic operation of the baling machine.

The primary object of this invention, therefore, is to provide a new and improved can-baling method.

Another object of this invention is to provide a can-baling method that treats the cans and compresses then into a firm bale that does not require binding or other securing means.

Other objects and advantages will be apparent in the following detailed description, taken in conjunction with the accompanying drawings.

DETAILED DESCRIPTION OF A PREFERRED EMBODIMENT

Figure 1:
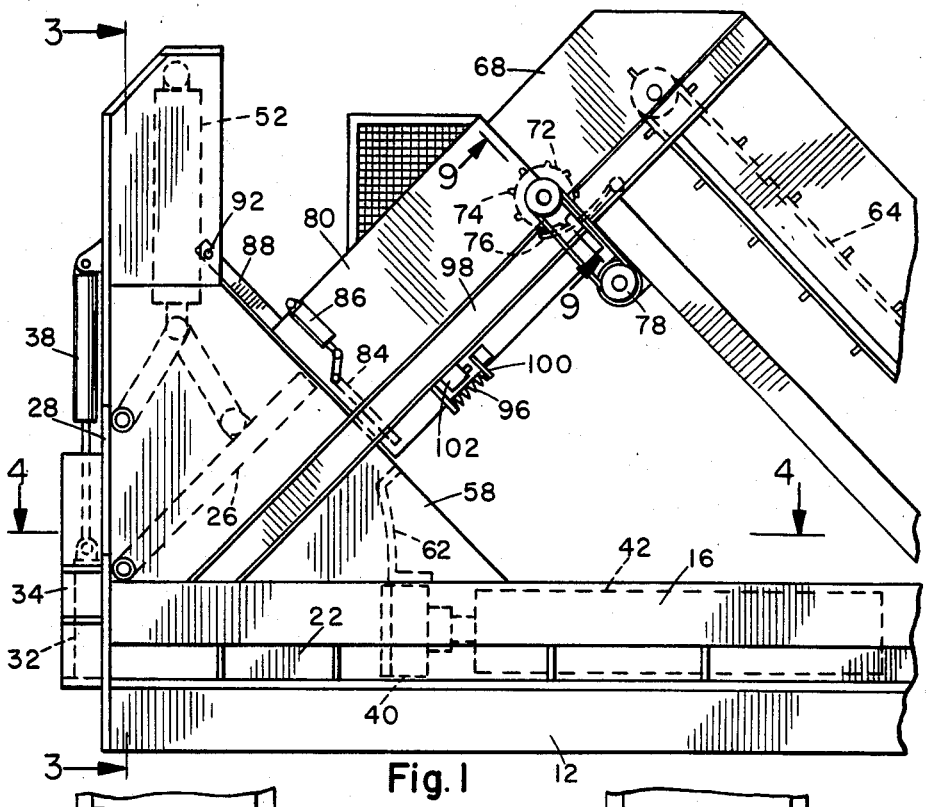
FIG. 1 is a side elevation view of the can-compacting apparatus.
Figure 2:
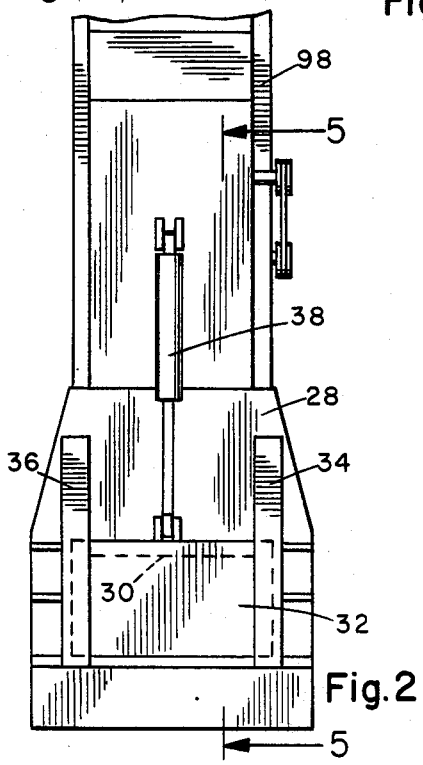
FIG. 2 is an end view as taken from the left-hand end of FIG. 1.
Figure 3:
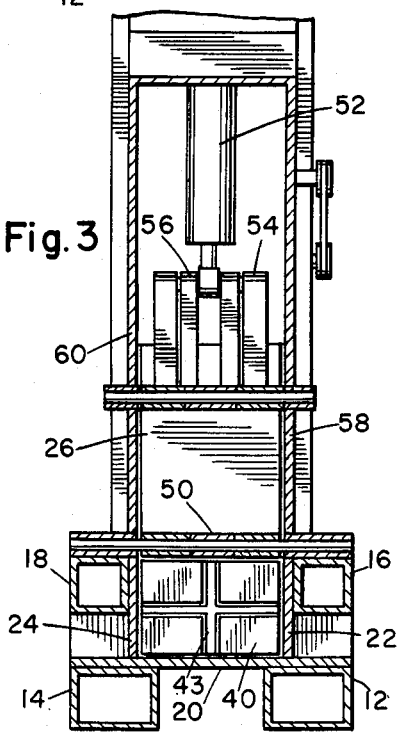
FIG. 3 is a sectional view taken on Line 3—3 of FIG. 1.
Figure 4:
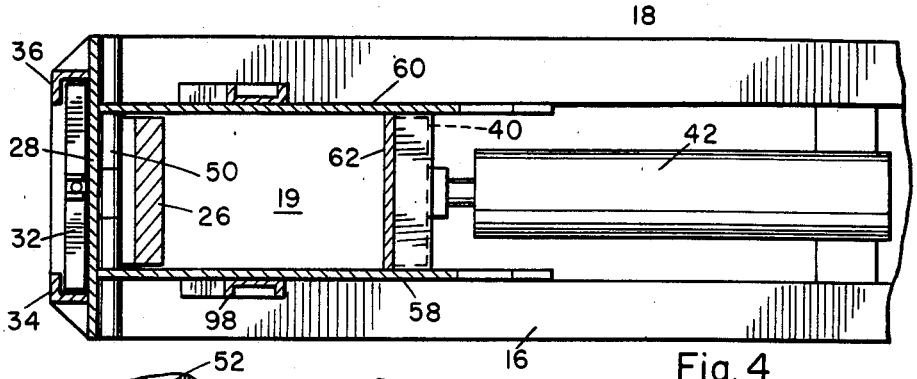
FIG. 4 is a sectional view taken on Line 4—4 of FIG. 1.

The machine has a generally horizontally-orientated compression or baling section defined by a housing, as shown in FIGS. 1 and 3, formed by means of a support structure including a pair of lower box beams 12 and 14 and a pair of upper box beams 16 and 18. A boxlike baling chamber 19 is formed between these spaced-apart beams by means of a flat steel bottom plate 20 secured and resting on the lower beams 12 and 14 and a pair of side plates 22 and 24 extending upward from the bottom plate 20 and secured between the box beams 16 and 18, a pivoting door 26 forming the top wall of the chamber.

A vertical end plate 28 forms the discharge end of the housing with a discharge opening 30 of a rectangular configuration, or baling chamber 19, formed in the end plate 28. A vertically sliding door 32 confined in a pair of side rails 34 and 36 and operated by hydraulic activator 38 closes the discharge opening 30 for the formulation of a bale and opens the discharge opening for the discharge of the bale.

Figure 5:
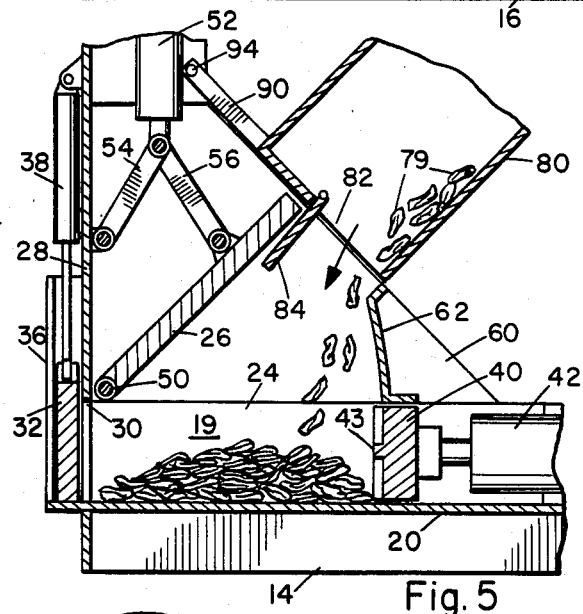
FIG. 5 is a sectional view taken on Line 5—5 of FIG. 2, showing the cans entering the bale-compacting chamber.
Figure 6:
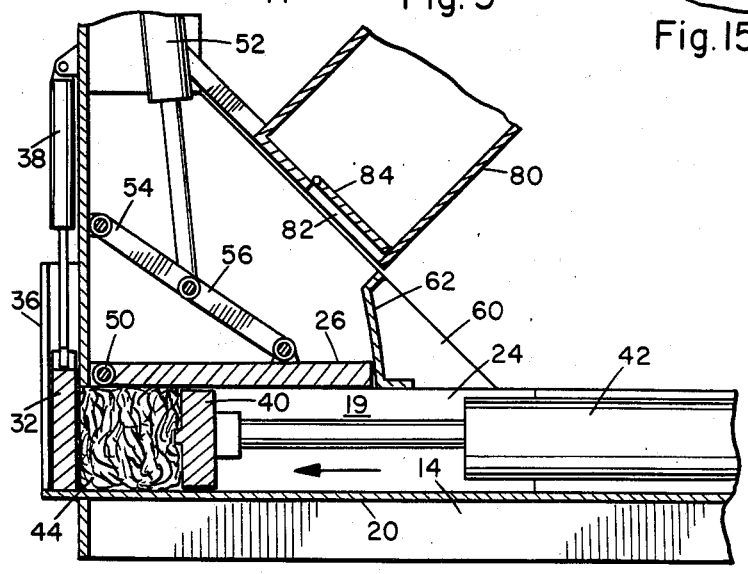
FIG. 6 is a sectional view similar to FIG. 5 showing the compacting action.
Figure 8:
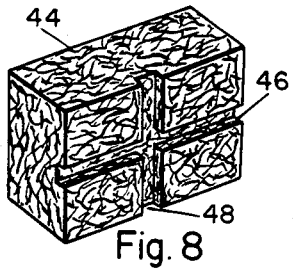
FIG. 8 is a perspective view of a single bale of compacted cans.

A plunger 40 is reciprocally mounted within the baling chamber 19 and is operated by means of a large hydraulic ram 42. The plunger 40, as can be seen in FIGS. 5 and 6, includes ribs 43 in the front face thereof for forming grooves in one face of a block or bale 44 of metal cans, as shown in FIG. 8. The bale 44 is formed with crossed grooves 46 and 48 to aid in the binding thereof into large stacks, as will be explained later.

Figure 7:
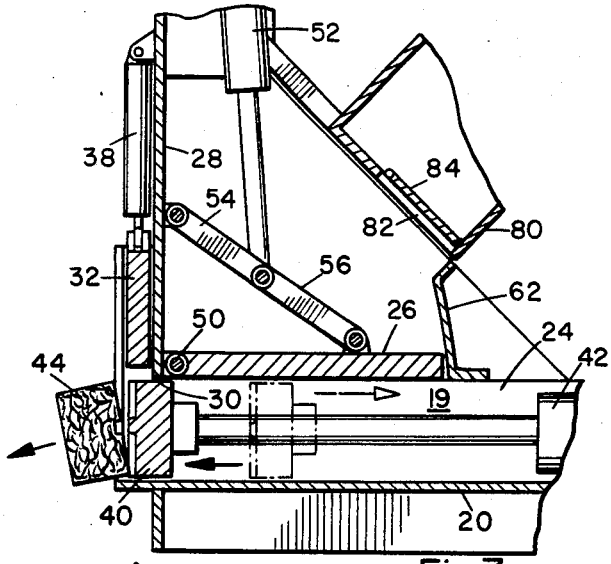
FIG. 7 is a sectional view similar to FIG. 6 showing the compacted bale being ejected.

The pivoting door 26 is hinged to the front wall 28 at pivot pin 50 and is moved from between the open and closed positions by means of a hydraulic ram or activator 52, which is connected by an overcenter toggle linkage including links 54 and 56 for locking the door 26 in its closed position, as shown in FIG. 7.

A hopper for channeling cans into the baling chamber includes a pair of generally triangular side plates 58 and 60 connected to the front plate and to the top of the side plates 22 and 24. A rear plate 62 extends upward from the baling chamber between side plates 58 an 60 to cooperate with the open door 26 for forming an open top chute for receiving a charge of cans.

Figure 15:
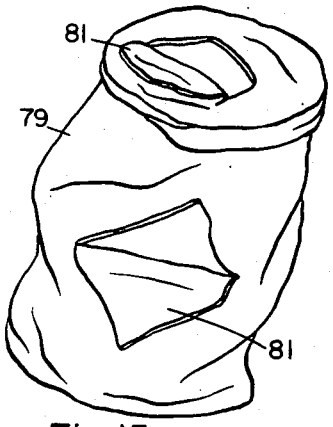
FIG. 15 illustrates a typical precrushed and torn can.
Figure 9A:
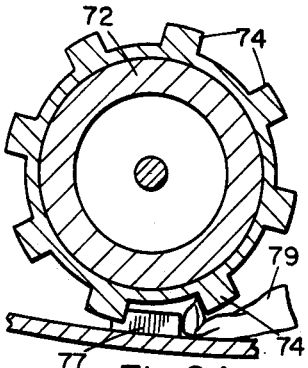
FIG. 9A is an enlarged sectional view taken on Line A—A of FIG. 9.
Figure 9:
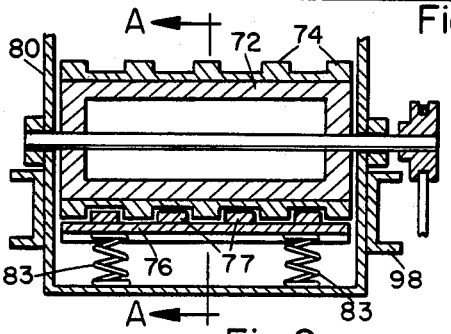
FIG. 9 is a sectional view taken on Line 9—9 of FIG. 1.

A feeding system for feeding cans into the aforementioned chute and into the baling chamber includes a conveyor belt 64 of conventional construction carrying cans from any suitable source upward to an upper position to fall by gravity down a chute 68 through a precrusher. The precrusher—shown in FIGS. 1, 9, and 9A—includes a rotating drum 72 having radially-extending teeth 74 for engaging and partially crushing cans passing between the drum and spring-biased backing plate 76. Teeth 74 are spaced axially along drum 72 in circumferential rows, and backing plate 76 has projecting ribs 77 which fit between the rows of teeth with a small clearance. As indicated in FIG. 9A, each can 79 is caught between confronting edges and corners of the ribs 77 and teeth 74 and is crushed and torn. In FIG. 15 a typical precrushed can is shown with ragged tabs 81 torn out and projecting. Springs 83 supporting the backing plate 76 in chute 68 allow the plate to be depressed for the cans to pass. It should be noted that the shredding and tearing will occur even with cans that are fed to the precrusher in already flattened condition, which they often are when collected for recycling. To ensure effective tearing, the teeth and ribs preferably have square or sharp edges and corners to catch the cans. This action thus shapes the cans in a fashion that has been found to cause a secure interentangling of the cans when compressed into a bale or block without the necessity of using a binder or straps. The precrusher is driven in a suitable manner, such as by an electric or hydraulic motor 78, or from any other suitable power source available on the machine.

The precrushed cans are caught and held in a charging bin 80, which has a generally boxlike configuration with a discharge opening 82 in the bottom thereof closable by means of a trap door 84, which is actuated by an activator 86. The charging bin 80 is pivotally supported by means of a pair of arms 88 and 90 for pivoting about pivot points 92 and 94 on the upper portions of the side plates 58 and 60. The weight of the charging bin is supported by a compression spring 96 fixed at the lower end to a support beam 98 or the like and to an upper bracket 100 on the charging bin. The bracket 100 is adapted to engage and activate a limit switch 102 upon movement of the charging bin 80 about pivots 92 and 94 under the weight of a predetermined charge of cans, e.g., 40 pounds.

Activation of the limit switch controls a sequence of the controlled operation of the system, as will be explained, for opening trap door 84 while the plunger 40 is in the retracted position to dump a full charge of cans into the baling chamber and the hopper. The cans dumped for a given load in many instances will be greater in volume than the open baling chamber can hold with the plunger 40 in the retracted position and will thus extend at least partially up into the hopper area.

In sequence, the activator 86 is activated closing the trap door 84 out of the way of door 26; then activator 52 is activated so that the door 26 is pressed downward on top of the cans filling the baling chamber and portion of the hopper above the chamber, thereby partially compressing the cans as the door 26 is moved downward into the closed position as shown in FIG. 6. After the door 26 has been closed, the ram 42 is activated forcing the plunger 40 to the left, as shown in FIGS. 5 and 6, thereby compressing the charge of cans into a bale 44 of a predetermined size and weight.

In the sequence of operation, as the plunger 40 has reached its leftmost limit position forming the compressed bale, the control system functions to partially retract the plunger 40, as shown in broken line in FIG. 7, allowing the bale 44 to partially expand and release its pressure on the gate 32 and permitting the activator 38 to raise the gate 32 upward, also as shown in FIG. 7; then the plunger again moves forward ejecting the bale 44 from the chamber.

Figure 10:
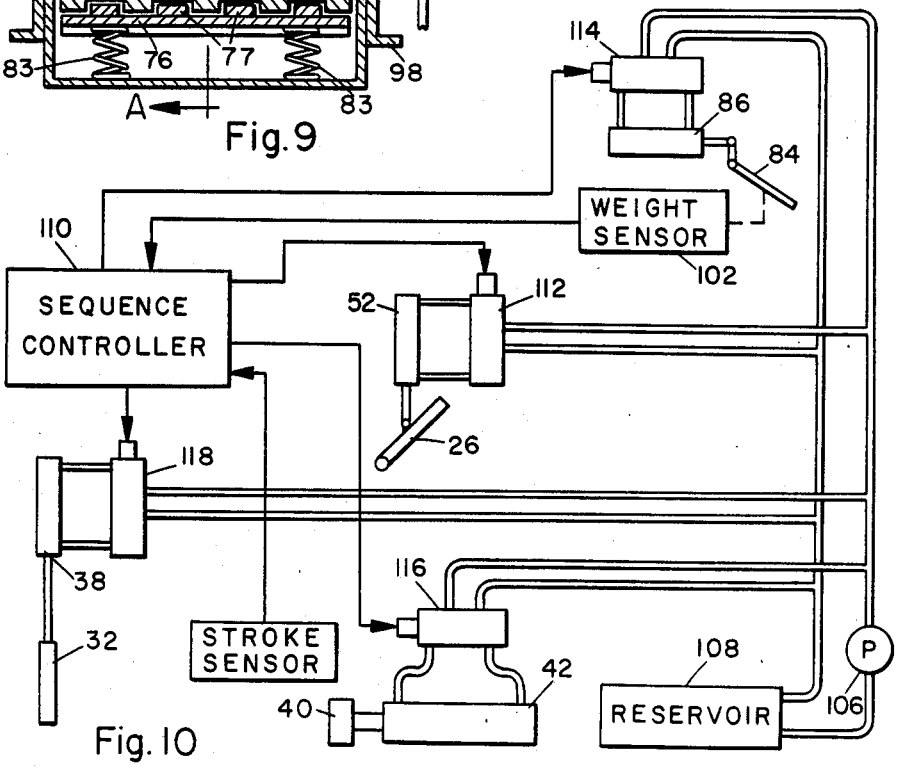
FIG. 10 illustrates schematically the operating system of the machine.
Figure 11:
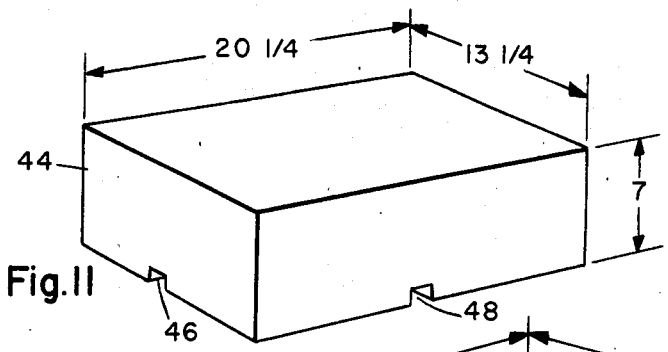
FIG. 11 illustrates the preferred size of the formed block.

Referring to FIG. 10, a schematic of the operating system of the machine is shown. The basic control system is preferably electrohydraulic with electrical switches controlling various hydraulic valves for directing pressurized hydraulic fluid for operation of the various hydraulic motors for powering the system. Basically the system comprises a source of pressurized hydraulic fluid including a pump 106 which draws fluid from a reservoir 108, which in a preferred embodiment will comprise the interior of the box beams 12 through 18 to thereby conserve space as well as materials. The pressurized fluid is made available to a series of valves which are controlled by a sequencer 110, which by a sequence operates the various valves within the system to perform the baling operating in a continuous, nonstop fashion.

In operation, the power to the machine is turned on with the pump 106 in operation supplying pressurized fluid to the system and the sequence controller 110 in operation. In the normal start position the machine components will be positioned, as shown in FIG. 1, with the plunger 40 in the retracted position, compression door 26 in the up position, gate or door 32 in the down or closed position, and trap door 84 closed. The machine receives loads of cans by way of conveyor 64 feeding them through the precrusher 72 and into the charging bin 80, where a full charge of approximately 40 pounds of cans is accumulated until the weight sensor switch 102 senses the predetermined charge by weight within the charging bin and stops the conveyor and signals the sequence controller 110.

The sequence controller then activates the activator 86 controlling the trap door 84 through a control valve 114 to open the trap door 84 and dump the charge of cans into the baling chamber 19 and hopper area therebove. Following the dumping of the charge into the baling chamber and hopper, the door 84 closes and the conveyor 64 resumes feeding cans into the precrusher while the activator 52 is activated through hydraulic valve 112 for closing the compression door 26 and precompressing the cans above the baling chamber into a mass within the chamber.

The door 32 is in the closed position and the ram 42 is activated through a control valve 116 for forcing the plunger 40 forward for compressing the cans within the baling chamber against he door 32. As the plunger reaches the end of its compression stroke compressing the block to its desired density and to the predetermined size, the plunger 40 stops and the sequence controller operates the valve 116 to partially retract the plunger 40 away from the compressed bale or block 44, relieving the pressure and, in sequence, activating the activator 38 through a valve 118 to open the door 32. The ram 42 is then activated forcing the block 44 from the discharge opening, as shown in FIG. 7. The ram 42 returns plunger 40 to the retracted position as gate 32 closes, and compression door 26 opens to await the next charge of cans.

Figure 12:
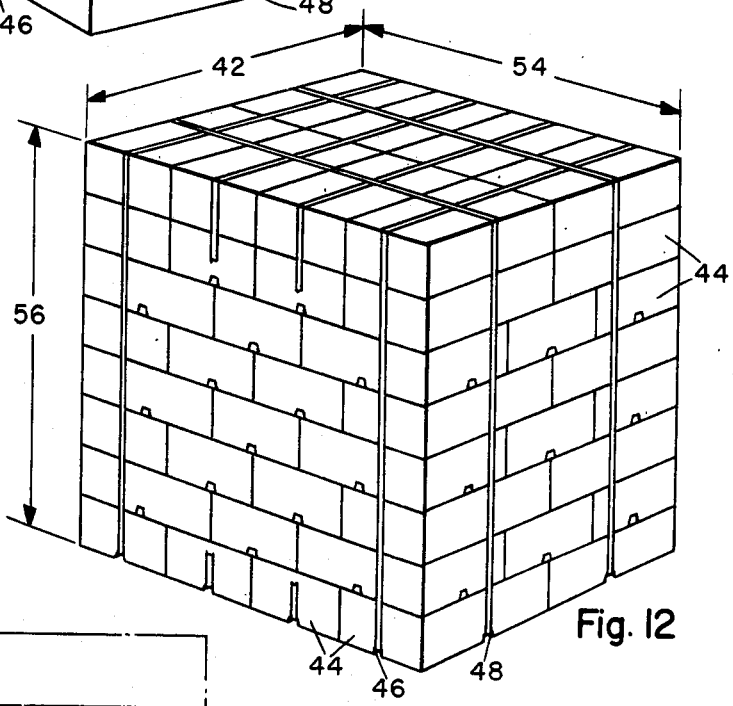
FIG. 12 illustrates an assembled stack of blocks.
Figure 13:
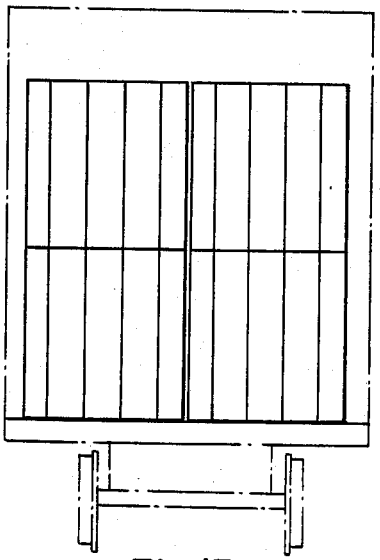
FIG. 13 shows four stacks within the cross section of a railroad box car.
Figure 14:
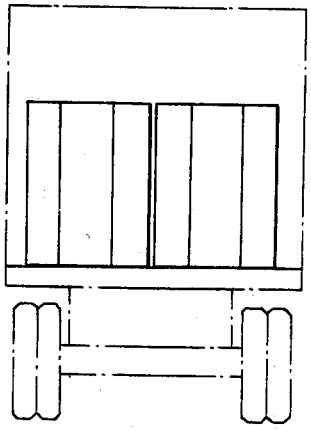
FIG. 14 shows two stacks side by side in the cross section of a truck.

The bales or blocks 44 are formed of a preferred size of about $20\frac{1}{4}\times13\frac{1}{4}\times7$ or 8 inches, so that they form a bale having a high density of about 40 pounds per cubic foot and can be stacked in an overlapping interlocking arrangement, as shown in FIG. 12, to fit either a rail car (FIG. 13) or a truck van (FIG. 14). The dimensions are critical in that they permit the interlocking relationship and stacking into stacks that can be bound together by straps or the like (FIG. 12), to form stacks of a size of $42\times54\times56$ inches—which can be handled by a lift truck, which can be loaded directly, and which fits into a highway van or railway box car. These are nominal sizes because cans will expand after extrusion from the bale chamber and portions will stick out from the surfaces of the bale. The individual compressed bales weigh approximately 40 pounds each and can be readily handled on an individual basis by a worker and stacked at reasonable heights without undue strain. The thickness of the bale can be either 7 inches or 8 inches, with the number of layers being either 7 or 8 to make a 56-inch-high stack.

While individual bales do not need to be bound or tied due to the interlocking action of the torn cans, the large stacks are bound by straps recessed in the collective grooves 46 and 48, which are aligned by the stacking. This facilitates handling on standard pallets by a forklift or the like, the recessed straps preventing breakage by the handling equipment.

Referring to FIG. 13, the stack sizes enable stacking two-wide (with 54-inch width) and two-high in a 10-foot-wide rail car.

Referring to FIG. 14, the stack sizes enable stacking two-wide (with 42-inch-width) and one-high (56-inch-height) in an 8-foot-wide highway van. These arrangements provide for economical transport and handling.

While we have illustrated and described our invention by means of specific embodiments, it is to be understood that numerous changes and modifications may be made therein without departing from the spirit and scope of the invention as defined in the appended claims.

We claim:

1. A method of baling cans, comprising the steps of:

feeding a plurality of cans between interengaging formations on opposed faces of a pre-crusher;

crushing the cans between the opposed faces and trapping and tearing portions of each can caught between the opposed formations to form flattened cans, each flattened can having ragged protruding portions;

feeding the crushed and torn cans into a baling chamber;

compressing the cans into a self-sustaining bale of a predetermined size and weight with a plunger; and discharging the bale out of the baling chamber.

2. The method as claimed in claim 1, wherein the step of compressing the cans into a bale comprises the further step of forming grooves in one face of the bale.

3. The method as claimed in claim 2, wherein the grooves comprise crossed grooves formed by crossed ribs on the can contacting face of the plunger.

4. The method as claimed in claim 1, wherein the step of crushing and tearing the cans to form crushed cans with ragged protruding portions comprises feeding the cans between pre-crusher faces having interengaging tooth formations between which the cans are caught to tear portions of the cans.

5. The method as claimed in claim 4, wherein the cans are fed between a first pre-crusher face comprising a rotating drum having axially spaced sets of projecting teeth and a second pre-crusher face comprising a stationary plate opposing the drum having ribs which fit between the sets of teeth to catch cans between the teeth and ribs.

6. A method of baling cans, comprising the steps of:

crushing a plurality of cans to form flattened cans having jagged protruding portions;

feeding the crushed cans into a baling chamber;

compressing the cans together with a plunger so that the protruding portions of adjacent cans entangle with one another to form a self-sustaining bale of predetermined size and weight; and discharging the bale out of the baling chamber.

7. A method of baling cans, comprising the steps of:

feeding a plurality of cans between interengaging formations on opposed faces of a crusher;

catching portions of the cans between crusher faces having opposed interengaging tooth formations to form protruding portions having jagged edges on each crushed can;

feeding the crushed cans having jagged protruding edges into a baling chamber;

compressing the cans together with a plunger so that the jagged protruding edges interengage to hold the cans together and form a self-sustaining bale of a predetermined size and weight; and discharging the bale out of the baling chamber.

* * * * *